US010994550B2

(12) United States Patent
Pangborn et al.

(10) Patent No.: US 10,994,550 B2
(45) Date of Patent: May 4, 2021

(54) REPLACEMENT AND PRIMING OF FLUID-EJECTION DEVICE FLUID SUPPLIES

(71) Applicant: HEWLETT-PACKARD DEVELOPMENT COMPANY, L.P., Spring, TX (US)

(72) Inventors: Michelle Pangborn, Corvallis, OR (US); Kelvin Chiew, Singapore (MY); Melissa S Gedraitis, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/499,296

(22) PCT Filed: Nov. 20, 2017

(86) PCT No.: PCT/US2017/062499
§ 371 (c)(1),
(2) Date: Sep. 29, 2019

(87) PCT Pub. No.: WO2019/099045
PCT Pub. Date: May 23, 2019

(65) Prior Publication Data

US 2020/0269592 A1 Aug. 27, 2020

(51) Int. Cl.
*B41J 2/175* (2006.01)

(52) U.S. Cl.
CPC ..... *B41J 2/17566* (2013.01); *B41J 2/17546* (2013.01); *B41J 2002/17589* (2013.01)

(58) Field of Classification Search
CPC ..... B41J 2/17566; B41J 2/17546; B41J 2002/17589; B41J 2/175
See application file for complete search history.

(56) References Cited

U.S. PATENT DOCUMENTS 6,098,843 A 8/2000 Soberanis et al.
6,786,566 B2 9/2004 Shindo
(Continued)

FOREIGN PATENT DOCUMENTS

JP 2015101073 6/2015

OTHER PUBLICATIONS

IP.com search (Year: 2020).*
(Continued)

*Primary Examiner* — Lisa Solomon
(74) *Attorney, Agent, or Firm* — Michael A Dryja

(57) ABSTRACT

When a first fluid supply of a fluid-ejection device is empty and a second fluid supply of the device has a non-empty fluid amount less than a threshold, the device performs an action related to the second fluid supply. After the action has been performed and both the first and second fluid supplies have been replaced, the device primes the first and second fluid supplies. The action can include emptying the second fluid supply, and then messaging that both the fluid supplies require replacement. The action can include messaging that both fluid supplies require replacement although the second fluid supply is not empty. The action can include not messaging even that the first fluid supply requires replacement until the second fluid supply also becomes empty.

14 Claims, 3 Drawing Sheets

(56) References Cited

U.S. PATENT DOCUMENTS

| | | | |
|---|---|---|---|
| 9,168,751 | B2 | 10/2015 | Uchiyama |
| 9,517,628 | B2 | 12/2016 | Tenkawa et al. |
| 2006/0092243 | A1 | 5/2006 | Langford et al. |
| 2011/0025802 | A1 | 2/2011 | Rosati et al. |
| 2011/0026058 | A1 | 2/2011 | Rosati et al. |
| 2011/0205292 | A1 | 8/2011 | Kneezel et al. |

OTHER PUBLICATIONS

IP.com search (Year: 2021).*
Canon-maintenance Tab Description, 2013, http://ugp01 .c-ij.com/ij/webmanual/PrinterDriver/W/G1000%20series/1.0/EN/PPG/Dg-Driver_Maintenance.html.

* cited by examiner

REPLACEMENT AND PRIMING OF FLUID-EJECTION DEVICE FLUID SUPPLIES

BACKGROUND

Fluid-ejection devices can include inkjet-printing devices. Inkjet-printing devices selectively output ink onto media like paper to form images on the media. Inkjet-printing devices can have ink of the constituent colors of a color space, as well as black ink, to form full color images on media. For example, the ink supplies of an inkjet-printing device can include cyan ink, magenta ink, yellow ink, and black ink so that the device can print full-color images.

DETAILED DESCRIPTION

Figure 1:
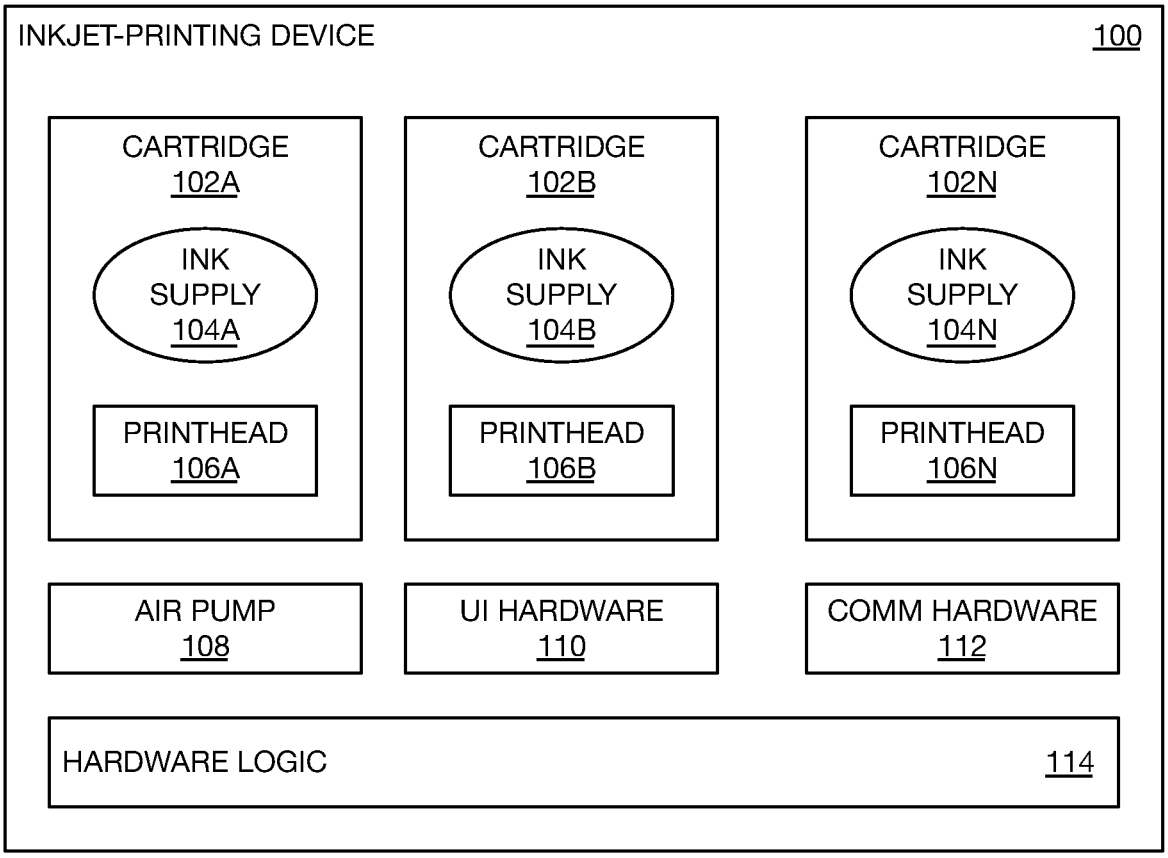
FIG. 1 is a block diagram of an example inkjet-printing device.

As noted in the background, inkjet-printing devices are one type of fluid-ejection device, and can print full-color images using ink supplies of different colors. In some types of inkjet-printing devices, an ink supply may be part of an inkjet cartridge that also includes the inkjet printhead by which ink is ejected, or jetted, onto media. In other types of inkjet-printing devices, an ink supply may be separate from any inkjet printhead, and may be either external or internal to the device.

When an ink supply of an inkjet-printing device is replaced, the device may have to prime the ink supply. Priming the ink supply can include using an air pump to cause removal of any air or other gas introduced into the ink path of the device during supply replacement. Priming the ink supply depletes a small amount of ink from the ink supply. However, if priming is not performed, then print quality can suffer, because air may be intermittently ejected from the inkjet printhead instead of ink, until the air has been exhausted from the device in this manner.

Some types of inkjet-printing devices have separately replaceable ink supplies. For example, a black ink supply may be separately replaceable from a cartridge including ink supplies of the other colors of ink, such as cyan, magenta, and yellow ink. As another example, the color ink supplies may also be separately replaceable. For instance, the cyan ink supply may be replaced without having to also replace the magenta, yellow, and black ink supplies.

Some types of inkjet-printing devices may have an air pump that simultaneously primes all the ink supplies. Such an inkjet-printing device may be unable to prime one ink supply without also priming at least one other ink supply, even if priming of the latter ink supply is unnecessary. For example, even if just the cyan ink supply has been newly replaced, priming the cyan ink supply may also result in priming of the magenta, yellow, and black ink supplies, although these latter supplies have not been replaced and thus do not need priming.

In such an inkjet-printing device, the follow scenario can occur. A first ink supply of an inkjet-printing device may become empty. The device may message a user that the first ink supply requires replacement, and the user responsively replaces the first ink supply with a fresh supply within the device. When the inkjet-printing device primes the first ink supply, such priming also results in a second ink supply of the device being primed.

However, the second ink supply may be near empty at the time priming occurs, and priming of the second ink supply may result in the second ink supply becoming empty. After performing priming of the ink supplies, therefore, the device may then message the user that the second ink supply now requires replacement. Thus, rather than the user being notified to replace both the first and second ink supplies at the same time, the user first is notified and correspondingly replaces the first ink supply, and during priming is then notified and has to correspondingly replace the second supply, too.

Techniques disclosed herein improve the user experience in this scenario, so that the user is not requested in short succession to replace ink supplies. When a first ink supply of an inkjet-printing device is empty and a second ink supply of the device has a non-empty fluid amount less than a threshold, the device performs an action prior to priming both ink supplies once the ink supplies have been replaced. For example, the inkjet-printing device may message the user that both ink supplies require replacement, even though the second ink supply is not yet empty.

As another example, the inkjet-printing device may proactively empty the second ink supply by performing a servicing or other action, and then message the user that both ink supplies now require replacement. As a third example, the device may continue printing images on media even though the first ink supply is empty, and without messaging the user that first ink supply is empty, until the second ink supply also becomes empty as a result of such image formation. Two or more of these techniques can also be combined.

FIG. 1 shows a block diagram of an example inkjet-printing device 100. The inkjet-printing device 100 may be a standalone inkjet printer, an all-in-one (AIO) device that includes inkjet printing as well as other functionality such as scanning, copying, or faxing, and so on. The inkjet-printing device 100 ejects or jets ink onto media, such as paper, to form images on the media. More generally, the inkjet-printing device 100 is a fluid-ejection device that ejects fluid.

The inkjet-printing device 100 can include inkjet cartridges 102A, 102B, . . . , 102N, which are collectively referred to as the inkjet cartridges 102. The inkjet cartridges 102 respectively include ink supplies 104A, 104B, . . . , 104N, which are collectively referred to as the ink supplies 104, as well as inkjet printheads 106A, 106B, . . . , 106N, which are collectively referred to as the inkjet printheads 106. An inkjet printhead 106 can include nozzles on a printhead die that selectively output ink from a corresponding ink supply 104. The ink supplies 104 are more generally fluid supplies, and the inkjet printheads 106 are more generally fluid-ejection mechanisms that selectively eject fluid of a corresponding fluid supply from the device 100.

In the example of FIG. 1, each ink supply 104 is included within an inkjet cartridge 102 together with a corresponding inkjet printhead 106. Therefore, replacing an inkjet cartridge 102 within the inkjet-printing device 100 results in replacement of both an ink supply 104 and a printhead 106. In another implementation, however, the ink supplies 104 may be separate from the inkjet printheads 106, so that the ink supplies 104 can be replaced separately from their corresponding printheads 106.

In the example of FIG. 1, each inkjet cartridge 102 includes one ink supply 104. For instance, there may be an inkjet cartridge 102 having a cyan ink supply 104, another inkjet cartridge 102 having a yellow ink supply 104, a third inkjet cartridge 102 having a magenta ink supply 104, and a fourth inkjet cartridge 102 having a black ink supply 104.

In another implementation, however, an inkjet cartridge 102 may include more than one ink supply 104, and the inkjet printhead 106 of the cartridge 102 may be responsible for outputting ink from each of these ink supplies 104. For instance, there may be a color inkjet cartridge 102 having cyan, yellow, and magenta ink supplies 104. In this scenario, there may still be a separate black inkjet cartridge 102 having a black ink supply 104.

In the example of FIG. 1, the ink supplies 104 are internal to the inkjet-printing device 100, and the inkjet cartridges 106 include both the ink supplies 104 and the printheads 106. For instance, the inkjet cartridges 102 of which the ink supplies 104 are a part may be removably inserted into the printing device 100. In other implementations, the ink supplies 104 may be separate from the printheads 106, and the ink supplies 104 may also be external to the device 100. In the latter case, tubing or other fluidic connections can connect the external ink supplies 104 to their corresponding inkjet printhead(s) 106 within the inkjet-printing device 100. Where the ink supplies 104 are separate from the printheads 106 and particularly where the ink supplies 104 are internal to the inkjet-printing device 100, the inkjet cartridges 106 may include just the ink supplies 104, such that the terminology "cartridge" and "supply" may be used interchangeably.

At least one ink supply 104 is of a different type from at least one other ink supply 104. As noted above, for instance, the ink supplies 104 may be of different colors, and thus of different types in this respect. Furthermore, at least one ink supply 104 is separately and independently replaceable as compared to at least one other ink supply 104. For example, the ink supply 104A may be replaced within the inkjet-printing device 100 without having to also replace the ink supply 104B within the device 100, by replacing the inkjet cartridge 102A including the ink supply 104A without also replacing the cartridge 102B including the ink supply 104B.

The inkjet-printing device 100 includes an air pump 108. The air pump 108 is fluidically connected to the ink supplies 104 and can be used to prime the ink supplies 104 when any ink supply 104 is replaced within the inkjet-printing device 100. Priming the ink supplies 104 in this respect can encompass removing any air or other gas introduced in the fluidic channels between an ink supply 104 and a corresponding printhead 106 as a result of inserting the ink supply 104 within the device 100. The air pump 108 may be a suction-type pump 108 that suctions such air or other gas from the newly replaced ink supply 104. Priming an ink supply 104 via the air pump 108 results in depletion, removal, or consumption of a small amount of ink from the ink supply 104.

In one implementation, the same air pump 108 is used to prime each ink supply 104 of the inkjet-printing device 100. Furthermore, in one implementation, the air pump 108 cannot selectively prime the ink supplies 104. That is, in this implementation, when any ink supply 104 is primed, at least one other ink supply 104 is also primed. For instance, when the air pump 108 primes one ink supply 104, all the ink supplies 104 may also be primed. In this implementation, then, the air pump 108 may be unable to prime any ink supply 104 without priming at least one other ink supply 104.

The inkjet-printing device 100 can include user interface hardware 110. The user interface hardware 110 can include one or more input devices, such as physical buttons, as well as switches, touchscreens, and so on, by which a user can provide input to the device 100. The user interface hardware 100 can include one or more output devices, such as physical displays, discrete light elements like light-emitting diodes (LEDs), as well as speakers, and so on, by which the device 100 can provide information to the user.

The inkjet-printing device 100 can include communication hardware 112. The communication hardware 112 can include a communication interface by which the device 100 can receive print jobs from a directly connected host device, or a network interface by which the device 100 can receive print jobs from host devices communicatively connected to the same network as the device 100. The communication hardware 112 may provide for wireless and/or wired communication. A host device can be a computing device like a desktop or laptop computer, a tablet computing device, a smartphone, and so on, as well as a storage device like a flash drive.

The inkjet-printing device 100 includes hardware logic 114 which may be implemented as a non-transitory computer-readable storage medium storing program code. The hardware logic 114 may include a processor that executes the program code. The hardware logic 114 may be an integrated circuit (IC) like an application-specific IC (ASIC) or a field-programmable gate array (FPGA) that effectively implements the program code and that can be considered a non-transitory computer-readable storage medium in this respect as well.

Figure 2:
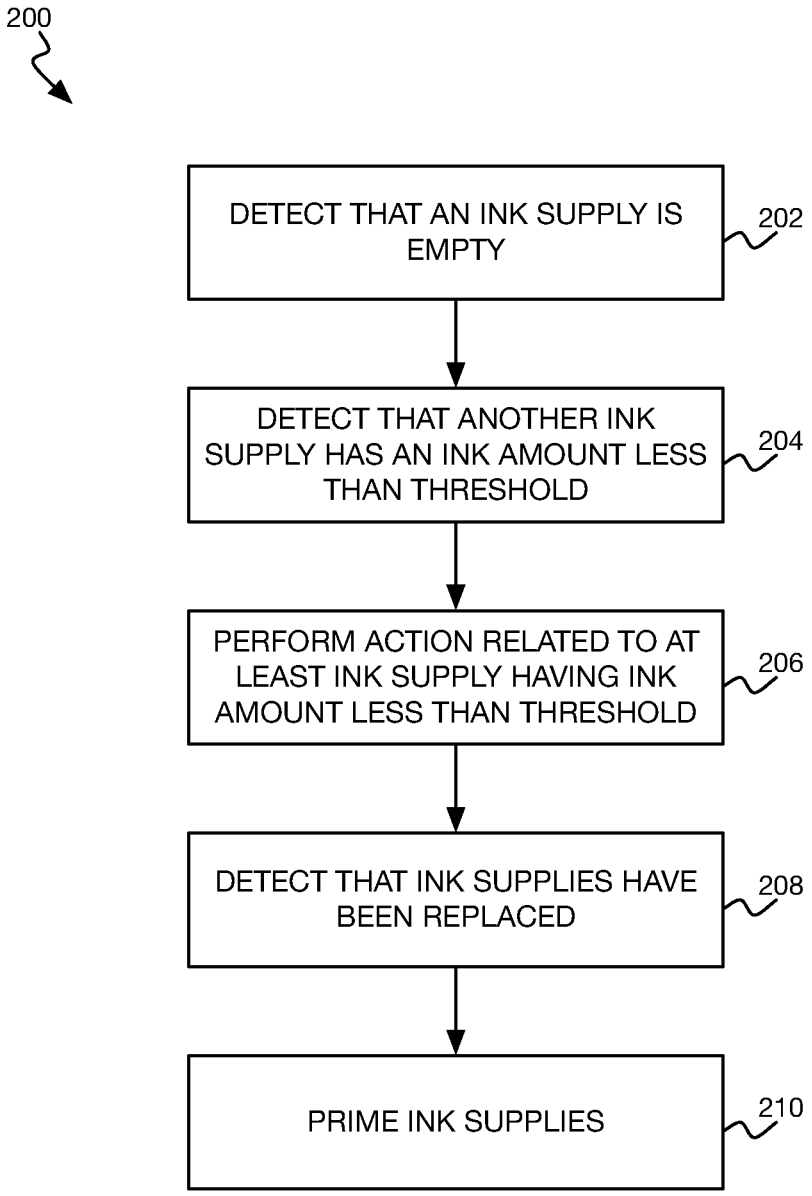
FIGS. 2, 3, 4, and 5 are flowcharts of example methods.

FIG. 2 shows an example method 200 for ensuring that a user is not requested in short succession to replace multiple ink supplies 104 of the inkjet-printing device 100. The method 200 can be performed by or otherwise implemented at the hardware logic 114 of the inkjet-printing device 100. The hardware logic 114 detects that an ink supply 104 has become empty (202). For instance, the ink cartridge 102 including the ink supply 104 may have a fluid sensor that detects when the amount of fluid of the ink supply 104 has decreased to an amount that is considered empty, where this amount may be slightly more than zero (i.e., a small amount of ink). In another implementation, the inkjet-printing device 100 may have a separate fluid sensor within fluidic coupling connected to the ink supply 104. The ink supply 104 may become empty while the inkjet-printing device 100 is printing a print job to form images on media. The hardware logic 114 may detect that more than one ink supply 104 has become empty in part 202.

In response to detecting that an ink supply 104 has become empty, the hardware logic 114 then detects in the method 200 that another, different ink supply 104 has an amount of ink less than a threshold (204). There may be more than one such other ink supply 104. Such an ink supply 104 is not considered as being empty. Rather, the amount of ink of the ink supply 104 is more than empty, but less than a threshold. The threshold may correspond to the amount of ink that is consumed during priming. The threshold amount of ink may thus be equal to the amount of ink that is depleted from an ink supply 104 when the inkjet-printing device 100 primes the supply 104.

In response to detecting that at least one ink supply 104 is empty in part 202 and that at least one ink supply 104 has a non-empty ink amount less than a threshold in part 204, the hardware logic 114 performs an action related to at least the one or more ink supplies having amounts of ink less than the threshold (206). Different implementations of part 206 are described later in the detailed description. In general, the action results in providing one notification that both the ink supply (or supplies) 104 detected as empty in part 202 and the ink supply (or supplies) 104 detected as having non-empty ink amounts less than the threshold in part 204 require replacement.

For instance, performance of the action in part 206 ensures that a user is not notified to replace an empty ink supply 104 (i.e., that which is detected in part 202), only to be notified shortly after replacing this ink supply 104 to replace another ink supply 104 (i.e., that which is detected in part 204). This scenario can occur when the latter ink supply 104 becomes empty during priming that is performed when the user replaces the former ink supply 104 within the inkjet-printing device 100. Notification that an ink supply 104 requires replacement and replacement of the ink supply 104 can respectively encompass notification that an ink cartridge 102 including the ink supply 104 requires and replacement of such an ink cartridge 102.

The hardware logic 114 detects that the user has replaced one or more ink supplies 104 within the inkjet-printing device 100 (208). The user is likely to have replaced the ink supply 104 detected as empty in part 202 and the ink supply 104 detected as having a non-empty ink amount less than the threshold in part 204, as a result of the action performed in part 206 including prompting to replace these ink supplies 104. Detection that an ink supply 104 has been replaced can include detecting that an ink supply 104 has been removed from the inkjet-printing device 100, and the insertion of a (new) ink supply 104. Detecting that an ink supply 104 has been replaced can include detecting that the amount of ink of the ink supply 104 has increased, which is presumed as corresponding to the ink supply 104 having been replaced. Detecting that an ink supply 104 has been replaced can be achieved in another manner as well. For instance, the user may have to press a button the inkjet-printing device 100 to indicate that the ink supplies 104 have been replaced.

In response to detecting that one or more ink supplies 104 have been replaced within the inkjet-printing device 100, the hardware logic 114 causes the air pump 108 to prime the ink supplies 104 (210). As noted above, the air pump 108 may not be able to selectively prime the ink supplies 104, such that all the ink supplies 104 have to be primed if any ink supply 104 is primed. Priming the ink supplies 104 removes air and other gas from the ink supplies 104, through fluidic channels such as tubing, to the printheads 106. The air pump 108, for instance, may be a suction-type pump that suctions any bubbles of air or other gas introduced within the ink in the inkjet-printing device 100 during ink supply replacement. As has been noted above, priming the ink supplies 104 results in the consumption or depletion of a small amount of ink from the ink supplies 104.

Performing priming of the ink supplies 104 is different than performing a cleaning operation. A cleaning operation is generally performed to expel any residual dry or other ink from the nozzles on the printheads 106 that can prevent ink from being ejected through the nozzles during printing. Such residual ink can become stuck on the printheads 106, for instance, when the inkjet-printing device 100 has remained unused for an inordinate length of time. Whereas priming may be performed just when ink supplies 104 are replaced within the inkjet-printing device 100, cleaning may be periodically performed or on an as-needed basis that may be initiated by the user.

Priming uses the air pump 108, whereas cleaning may not. Rather, cleaning can be achieved by a spitting operation that forcibly ejects a relatively large volume of ink from the nozzles of the printheads 106. Cleaning can also involve moving the printheads 106 against a wiper, or a wiper against the printheads 106, in inkjet-printing devices 100 that include a wiper. By comparison, priming may not involve any wiping action. Priming and cleaning thus differ from one another in action, intention, and effect.

Figure 3:
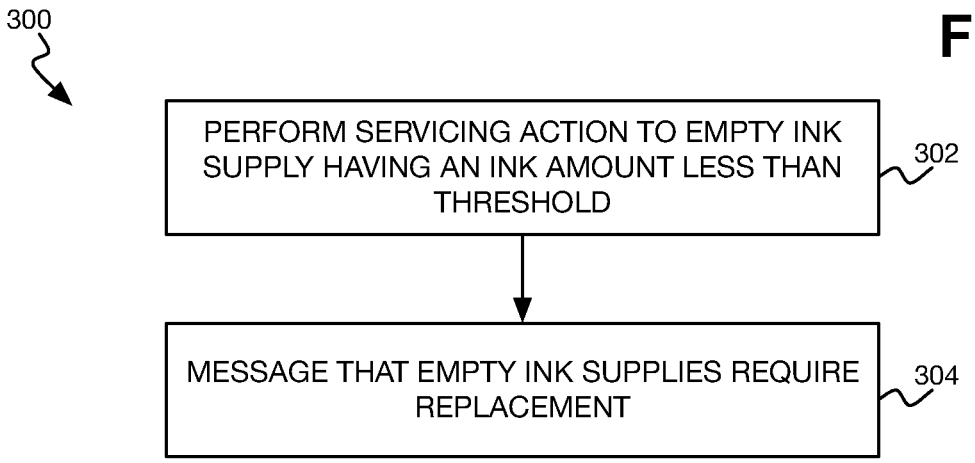
Figure 4:
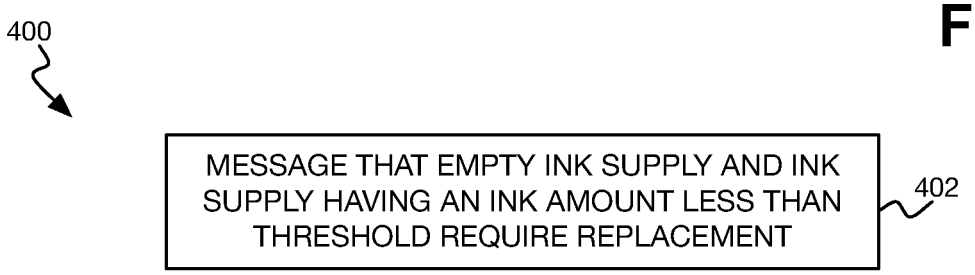
Figure 5:
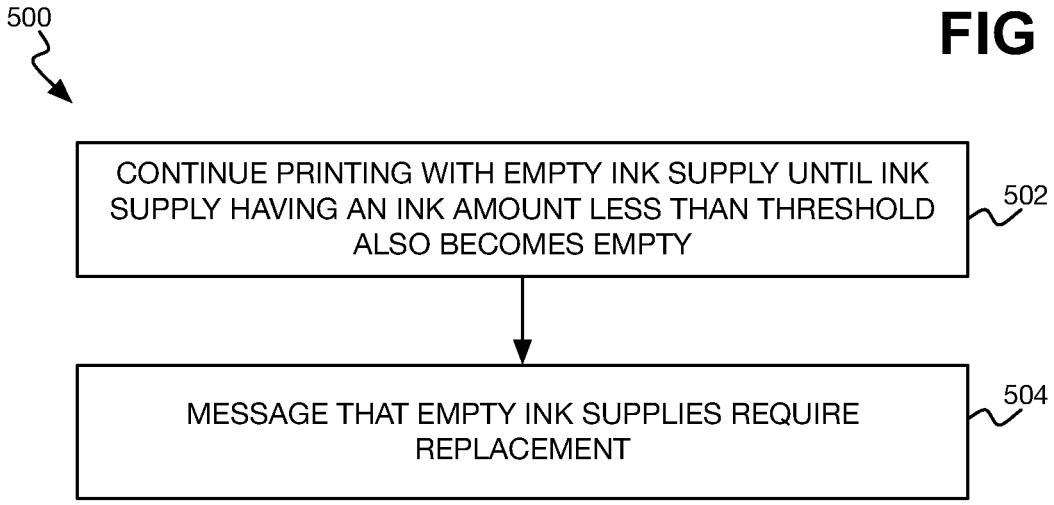

FIGS. 3, 4, and 5 respectively show different example methods 300, 400, and 500 that can be performed to implement part 206 of the method 200. In other implementations, the methods 300, 400, and 500 can be selectively combined in different ways. The methods 300, 400, and 500 implement one or more actions that are performed responsive to detection of an ink supply 104 that is empty and another ink supply 104 that is not yet empty but that has less ink than a threshold.

In the method 300, the hardware logic 114 of the inkjet-printing device 100 can initiate a servicing action to empty the ink supply 104 that has an ink amount less than the threshold as detected in part 204 of the method 200 (302). The servicing action can be the aforementioned cleaning or spitting operation. The servicing action of part 302 is performed to empty the remaining ink from the ink supply 104.

Thereafter, the hardware logic 114 responsively messages the user that the empty ink supply 104 detected in part 202 of the method 200 and the now-empty ink supply 104 detected in part 204 require replacement (304). For instance, the hardware logic 114 may sound an audible alert, and/or display a notification on display hardware of the inkjet-printing device 100. The hardware logic 114 may send a host device to which the inkjet-printing device 100 is connected a message indicating that the ink supplies 104 in question are empty and require replacement.

In the method 400, the hardware logic 114 can immediately message the user that the empty ink supply 104 detected in part 202 of the method 200 and the near-empty ink supply 104 detected in part 204 require replacement (402). That is, the hardware logic 114 does not first empty the near-empty ink supply 114 of ink as in part 304 of the method 300. As such, in part 402, the hardware logic 114 messages the user that ink supplies 104 detected in part 202 and 204 require replacement, even though the ink supply detected in part 202 is in fact not empty.

In the method 500, the hardware logic 114 may continue printing print jobs sent by host devices connected to the inkjet-printing device 100 until the ink supply 104 detected in part 204 runs out of ink and becomes empty (502), before messaging the user that the empty ink supply 104 detected in part 202 of the method 200 and the now-empty ink supply 104 detected in part 204 are empty and require replacement (504). That is, in the method 500, the hardware logic 114 refrains from messaging that the ink supplies detected in parts 202 and 204 of the method 200 require replacement until the ink supply detected in part 204 is also empty. The hardware logic 114 thus continues printing print jobs, such as a current print job that may have resulted in the ink supply 104 detected in part 202 becoming empty, even though this ink supply 104 is empty.

The techniques that have been described improve the user experience in the scenario in which one ink supply of an inkjet-printing device is empty, and another ink supply is near empty and will likely become empty once priming occurs. The techniques improve the user experience by ensuring that the user is more likely to replace both ink supplies at the same time. That is, the user is notified or prompted to replace both ink supplies. As such, the user is not notified to replace one ink supply, only to be notified to replace another ink supply shortly after the former ink supply is replaced, due to priming causing the latter ink supply to also become empty. Although these techniques have been described herein in relation to ink supplies of an inkjet-printing device, they are more generally applicable to fluid supplies of a fluid-ejection device, regardless of whether the fluid supplies are part of cartridges that include fluid-ejection mechanisms, too.

We claim:

1. A method comprising:

detecting, by a fluid-ejection device, that a first fluid supply of the fluid-ejection device is empty and that a second fluid supply of the fluid-ejection device has a non-empty fluid amount less than a threshold corresponding to an amount of fluid consumed during priming that is performed when a fluid supply is replaced to ready the fluid supply for usage;

responsively performing, by the fluid-ejection device, an action related to the second fluid supply;

subsequently detecting, by the fluid-ejection device, that the first and second fluid supplies have been replaced; and responsively priming, by the fluid-ejection device, the first and second fluid supplies to ready the first and second fluid supplies for usage.

2. The method of claim 1, wherein performing the action comprises:

performing a servicing action that depletes the non-empty fluid amount from the second fluid supply, the second fluid supply becoming empty; and subsequently messaging that the first and second fluid supplies require replacement.

3. The method of claim 1, wherein performing the action comprises:

messaging that the first and second fluid supplies require replacement, the first fluid supply being empty and the second fluid supply being non-empty.

4. The method of claim 1, wherein performing the action comprises:

performing printing of print jobs while the first fluid supply is empty, until the second fluid supply is also empty; and subsequently messaging that the first and second fluid supplies require replacement.

5. A fluid-ejection device comprising:

first and second fluid supplies;

a fluid-ejection mechanism to eject fluid from the first and second fluid supplies;

an air pump to prime the first and second fluid supplies; and hardware logic to:

detect that a first fluid supply of the fluid-ejection device is empty and a second fluid supply of the fluid-ejection device has a non-empty fluid amount less than a threshold corresponding to an amount of fluid consumed during priming that is performed when a fluid supply is replaced to ready the fluid supply for usage, and responsively perform an action related to the second fluid supply; and subsequently prime the first and second fluid supplies using the air pump upon replacement of both the first and second fluid supplies to ready the first and second fluid supplies for usage.

6. The fluid-ejection device of claim 5, wherein hardware logic is to perform the action related to the second fluid supply by:

emptying the second fluid supply; and subsequently messaging that the first and second fluid supplies require replacement.

7. The fluid-ejection device of claim 5, wherein performing the action comprises:

messaging that the first and second fluid supplies require replacement even though the second fluid supply is not empty.

8. The fluid-ejection device of claim 5, wherein performing the action comprises:

refraining from messaging that the first and second fluid supplies require replacement until the second fluid supply also becomes empty.

9. The fluid-ejection device of claim 5, wherein priming of the first fluid supply using the air pump results in the air pump also priming the second fluid supply, the air pump unable to prime the first fluid supply without also priming the second fluid supply.

10. The fluid-ejection device of claim 9, wherein the first and second fluid supplies are of different types, and are separately replaceable within the fluid-ejection device.

11. A non-transitory computer-readable data storage medium storing program code executable by a fluid-ejection device to:

when a first fluid supply of the fluid-ejection device is empty and a second fluid supply of the fluid-ejection device has a non-empty fluid amount less than a threshold corresponding to an amount of fluid consumed during priming that is performed when a fluid supply is replaced to ready the fluid supply for usage, perform an action related to the second fluid supply; and after the action has been performed and both the first and second fluid supplies have been replaced, prime the first and second fluid supplies to ready the first and second fluid supplies for usage.

12. The non-transitory computer-readable data storage medium of claim 11, wherein the fluid-ejection device is to perform the action related to the second fluid supply by:

depleting the non-empty fluid amount from the second fluid supply, the second fluid supply becoming empty; and subsequently messaging that the first and second fluid supplies require replacement.

13. The non-transitory computer-readable data storage medium of claim 11, wherein the fluid-ejection device is to perform the action related to the second fluid supply by:

messaging that the first and second fluid supplies require replacement although the second fluid supply is not empty.

14. The non-transitory computer-readable data storage medium of claim 11, wherein the fluid-ejection device is to perform the action related to the second fluid supply by:

when the second fluid supply becomes empty, messaging that the first and second fluid supplies require replacement, no messaging that the first fluid supply requires replacement being performed until the second fluid supply also becomes empty.

* * * * *